US008801474B2

(12) United States Patent
Rong et al.

(10) Patent No.: US 8,801,474 B2
(45) Date of Patent: Aug. 12, 2014

(54) ELECTRICAL CONNECTOR WITH FASTENING MEMBER FASTENED TO POWER CONTACT

(75) Inventors: Zhi-Qiang Rong, Taicang (CN); Hai-Lang Wang, Taicang (CN); Jin Li, Taicang (CN)

(73) Assignee: Alltop Electronics (Suzhou) Ltd., Taicang (CN)

( * ) Notice: Subject to any disclaimer, the term of this patent is extended or adjusted under 35 U.S.C. 154(b) by 60 days.

(21) Appl. No.: 13/550,013

(22) Filed: Jul. 16, 2012

(65) Prior Publication Data

US 2013/0303033 A1 Nov. 14, 2013

(30) Foreign Application Priority Data

May 10, 2012 (CN) ..... 2012 1 0143804

(51) Int. Cl.
*H01R 13/42* (2006.01)

(52) U.S. Cl.
USPC ..... 439/737

(58) Field of Classification Search
USPC ..... 439/737, 626, 540.1
See application file for complete search history.

(56) References Cited

U.S. PATENT DOCUMENTS

| | | | | |
|---|---|---|---|---|
| 3,880,494 | A * | 4/1975 | Reed et al. | 439/517 |
| 6,109,937 | A * | 8/2000 | Bonilla et al. | 439/107 |
| 6,224,430 | B1 * | 5/2001 | Kusuda et al. | 439/709 |
| 6,881,102 | B2 * | 4/2005 | Correll et al. | 439/752 |
| 7,004,796 | B2 * | 2/2006 | Fukuda et al. | 439/752 |
| 7,285,019 | B2 * | 10/2007 | Sakai et al. | 439/620.09 |
| 7,727,001 | B2 * | 6/2010 | Percherke et al. | 439/378 |
| 7,759,899 | B2 * | 7/2010 | Hanawa et al. | 320/114 |
| 8,133,064 | B2 * | 3/2012 | Nishimura | 439/107 |
| 8,419,476 | B1 * | 4/2013 | Yu et al. | 439/626 |
| 2004/0161975 | A1 * | 8/2004 | Sakai et al. | 439/620 |

* cited by examiner

*Primary Examiner* — Alexander Gilman
(74) *Attorney, Agent, or Firm* — Sughrue Mion, PLLC

(57) ABSTRACT

An electrical connector includes an insulative housing (10) defining a passageway (11) therein, a power contact (20) received in the passageway and a fastening member (28) for mating with the power contact. The power contact includes a pair of contacting portions (21) and a connecting portion (22) connecting the pair of contacting portions. The pair of contacting portions is essentially parallel to each other and a spacing (210) is defined therebetween. The connecting portion includes a fastening portion (23) essentially perpendicular to the pair of contacting portions. The fastening member (28) is separately made from the power contact to fasten securely to the fastening portion (23). Thus, the power contact can be reliably fixed in the insulative housing.

17 Claims, 6 Drawing Sheets

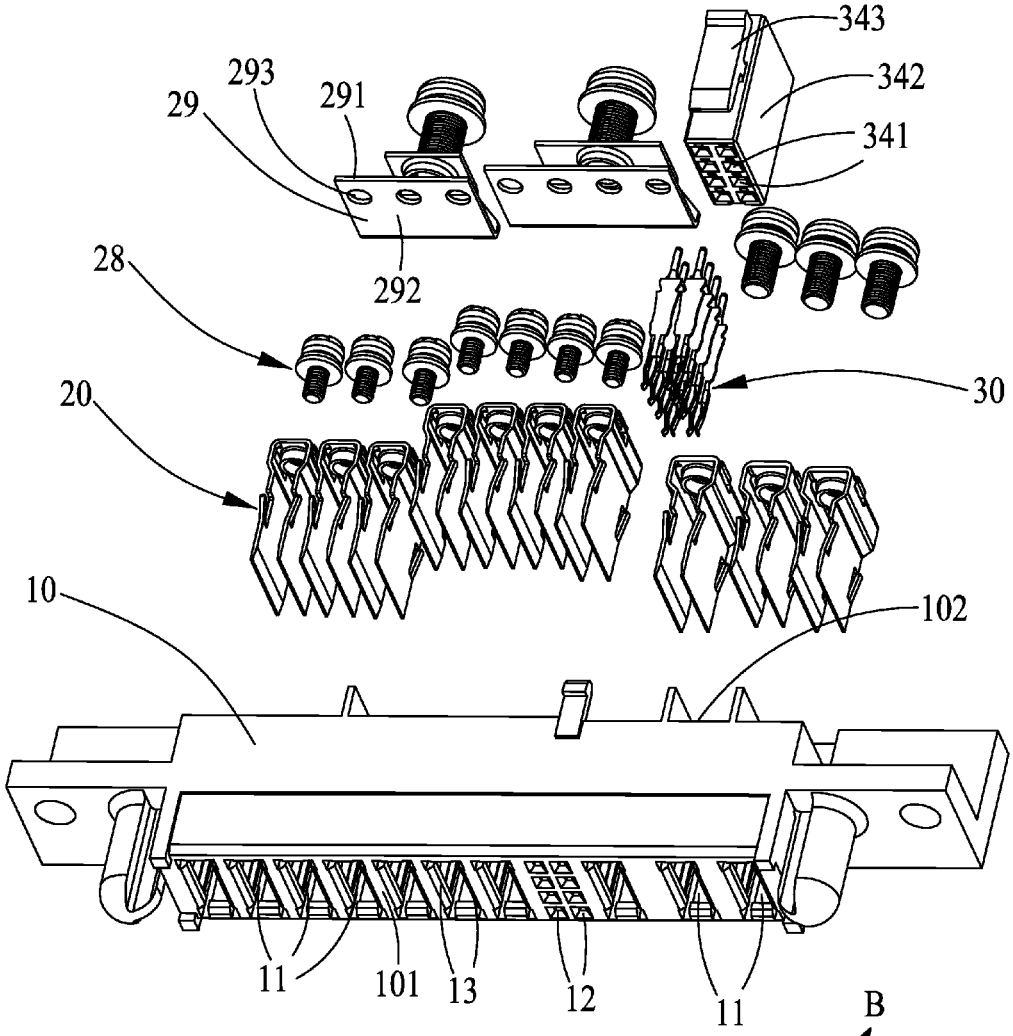
FIG.2
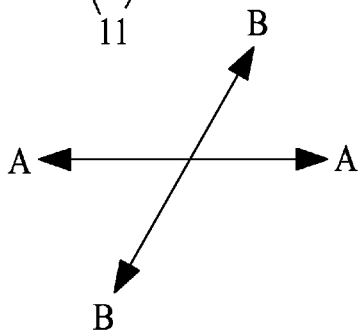

ELECTRICAL CONNECTOR WITH FASTENING MEMBER FASTENED TO POWER CONTACT

BACKGROUND OF THE INVENTION

1. Field of the Invention

The present invention relates to an electrical connector, and more particularly to an electrical connector with improved fastening members for securely retaining power contacts thereof.

2. Description of Related Art

Power connectors have been widely applied in different electronic fields. A power connector usually includes inner and outer layers of contacts which act respectively as the positive and the negative poles of a power supply. The power connector provides work voltage for the electronic components via the positive and the negative poles. A conventional power connector includes an insulative housing, a plurality of power contacts for power transmission and a plurality of signal contacts for signal transmission. The power contacts are capable of serving as the contacts for the positive and the negative poles. However, since the power contacts usually have a high profile rate, therefore it is often for the power contacts to face heavy insertion and withdrawal force. Thus, if the power contacts are not fixed securely in the insulative housing, they will be easily damaged or loosen from the housing.

Hence, it is desirable to provide an electrical connector for securely retaining power contacts therein.

BRIEF SUMMARY OF THE INVENTION

The present invention provides an electrical connector including an insulative housing, a power contact mounted in the insulative housing and a fastening member for mating with the power contact. The insulative housing extends along a longitudinal direction and defines a mating surface thereon, a mounting surface is defined opposite to the mating surface and a passageway extend through the mating surface and the mounting surface. The passageway extends along a transverse direction perpendicular to the longitudinal direction. The power contact is received in the passageway of the insulative housing. The power contact includes a pair of contacting portions and a connecting portion connecting the pair of contacting portions. The pair of contacting portions is essentially parallel to each other and define therebetween a spacing. The connecting portion includes a fastening portion which is essentially perpendicular to the pair of contacting portions. The fastening member is separately made from the power contact while is securely fastened to the fastening portion. As a result, the power contact can be reliably fixed in the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 2 is an exploded view of the electrical connector as shown in FIG. 1;

DETAILED DESCRIPTION OF THE PREFERRED EMBODIMENT

Figure 1:
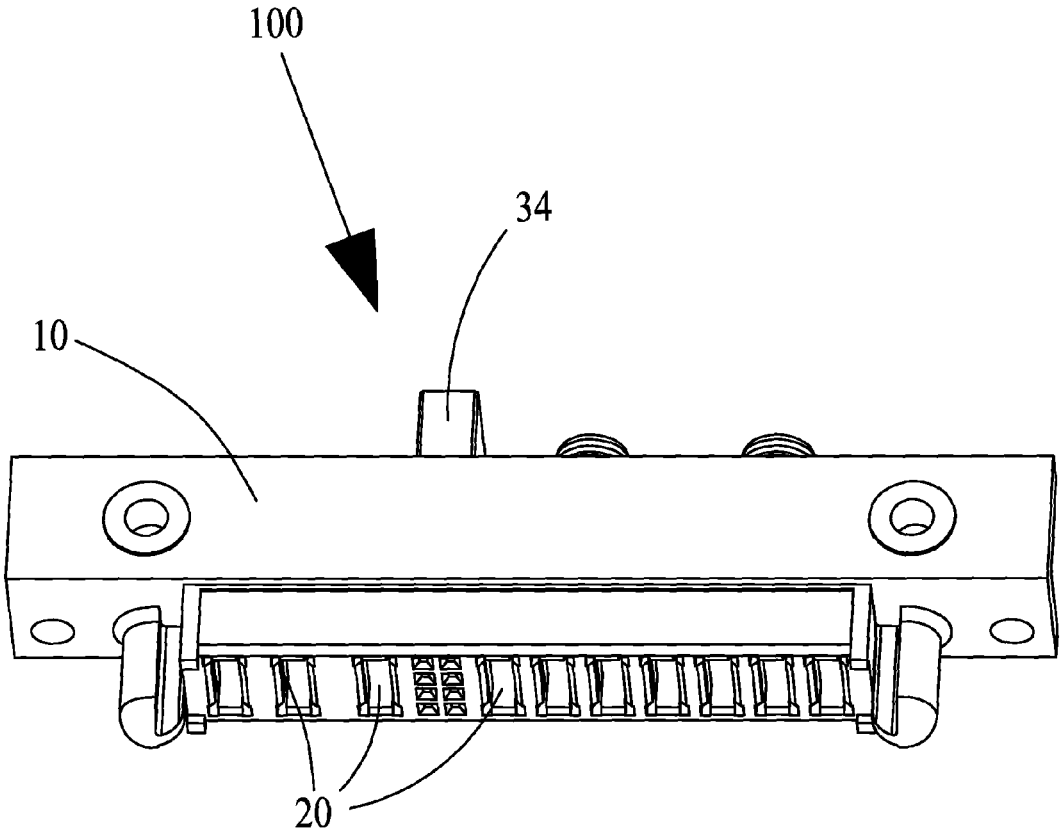
FIG. 1 is a perspective view of an electrical connector in accordance with an illustrated embodiment of the present invention.

Reference will now be made to the drawing figures to describe the preferred embodiment of the present invention in detail. As shown in FIGS. 1 and 2, the illustrated embodiment of the present invention discloses an electrical connector 100, also known as a power connector, including an insulative housing 10, a plurality of power contacts 20 retained in the insulative housing 10, a plurality of signal contacts 30 and a plurality of fastening members 28 for securely fastening the power contacts 20 to insulative housing 10.

Figure 3:
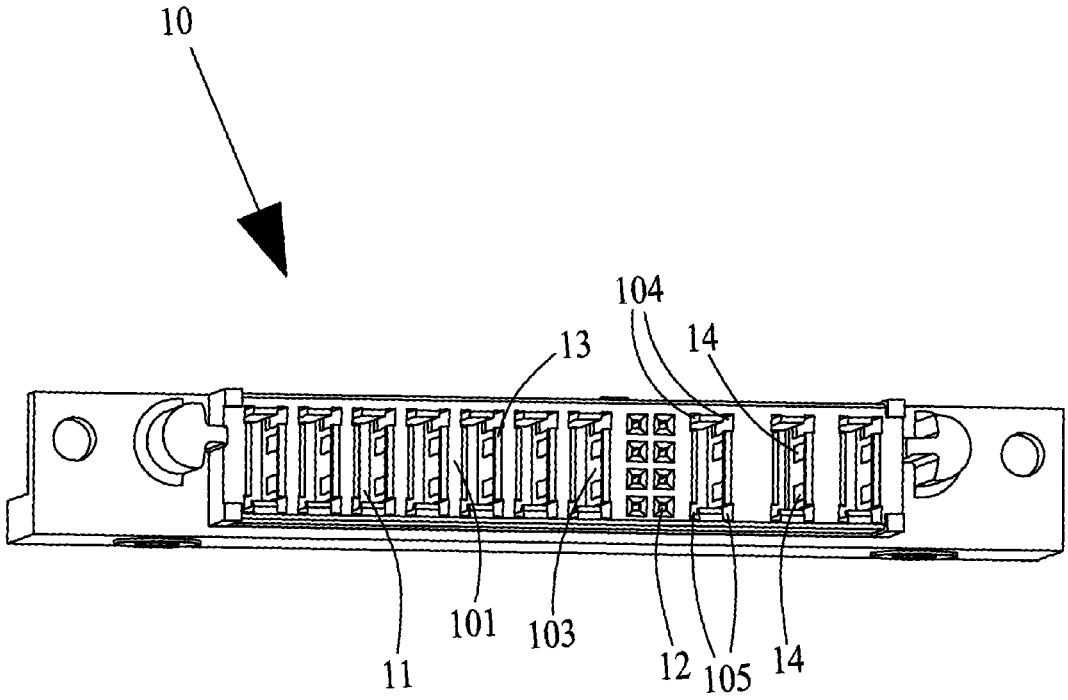
FIG. 3 is a front perspective view of an insulative housing of the electrical connector.
Figure 4:
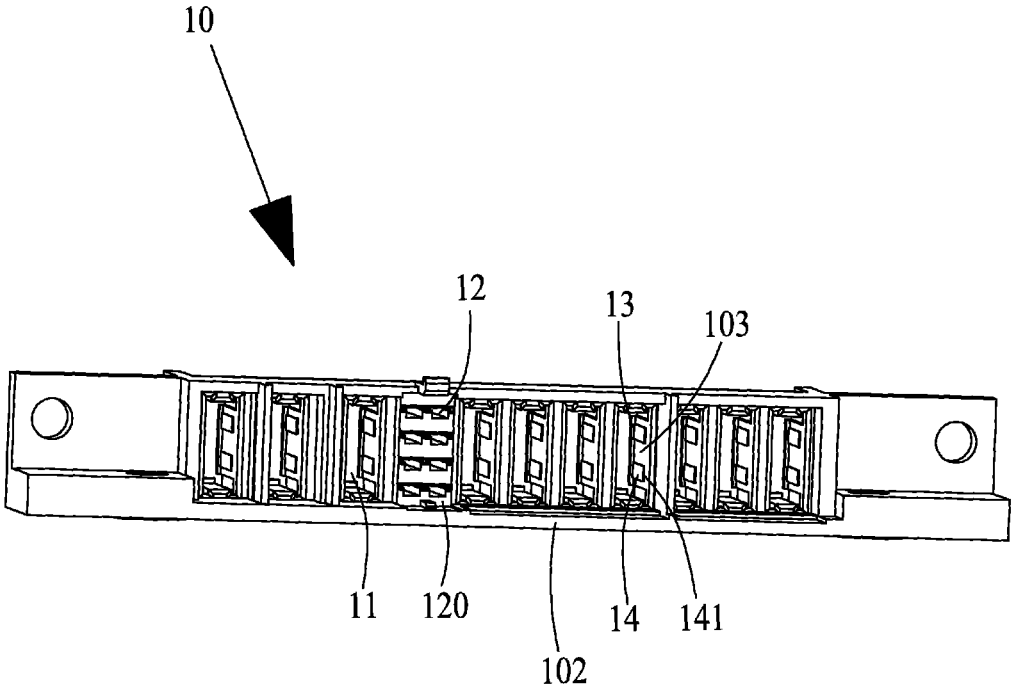
FIG. 4 is a rear perspective view of the insulative housing of the electrical connector.

Referring to FIGS. 2 to 4, the insulative housing 10 extends along a longitudinal direction A-A and includes a front mating surface 101, a rear mounting surface 102 and a plurality of passageways 11 extending through the mating surface 101 and the mounting surface 102 along a transverse direction B-B perpendicular to the longitudinal direction A-A. The passageways 11 are essentially rectangular shaped from a front view and are adapted for mounting the power contacts 20 along a back-to-front direction. The power contacts 20 are divided into three groups and retained in the insulative housing 10 according to the illustrated embodiment of the present invention, especially as shown in FIG. 2.

Referring to FIGS. 3 and 4, the insulative housing 10 defines a rear cavity 120 extending through the mounting surface 102 and a plurality of mating holes 12 extending through the mating surface 101. The mating holes 12 are in communication with the rear cavity 120.

As shown in FIGS. 1 to 4, corresponding to each passageway 11, the insulative housing 10 includes a pair of guiding blocks 13 extending thereinto. The guiding blocks 13 are located adjacent to the mating surface 101 of the insulative housing 10 and are adapted for not only guiding insertion of a corresponding contact of a mateable connector (not shown), but also preventing the power contacts 20 from being over-inserted into the passageways 11 along the back-to-front direction. Each passageway 11 is formed between a pair of inner side walls 103 of the insulative housing 10. Each inner side wall 103 includes a pair of blocks 14 protruding into the passageway 11. The pair of blocks 14 are vertically symmetrical with each other along a middle line (not shown) therebetween. Each block 14 includes an inclined surface 141 in order to form a relative greater heat-dissipation gap (not shown) with respect to the power contact 20. Besides, the insulative housing 10 defines a pair of upper positioning slots 104 and a pair of lower positioning slots 105 located at a top side and a bottom side of each passageway 11, respectfully. The upper positioning slots 104 and the lower positioning slots 105 are in communication with corresponding passageway 11. The upper positioning slots 104 and the lower positioning slots 105 are in communication with corresponding heat-dissipation gap for better dissipating the heat generated from the power contacts 20.

Figure 5:
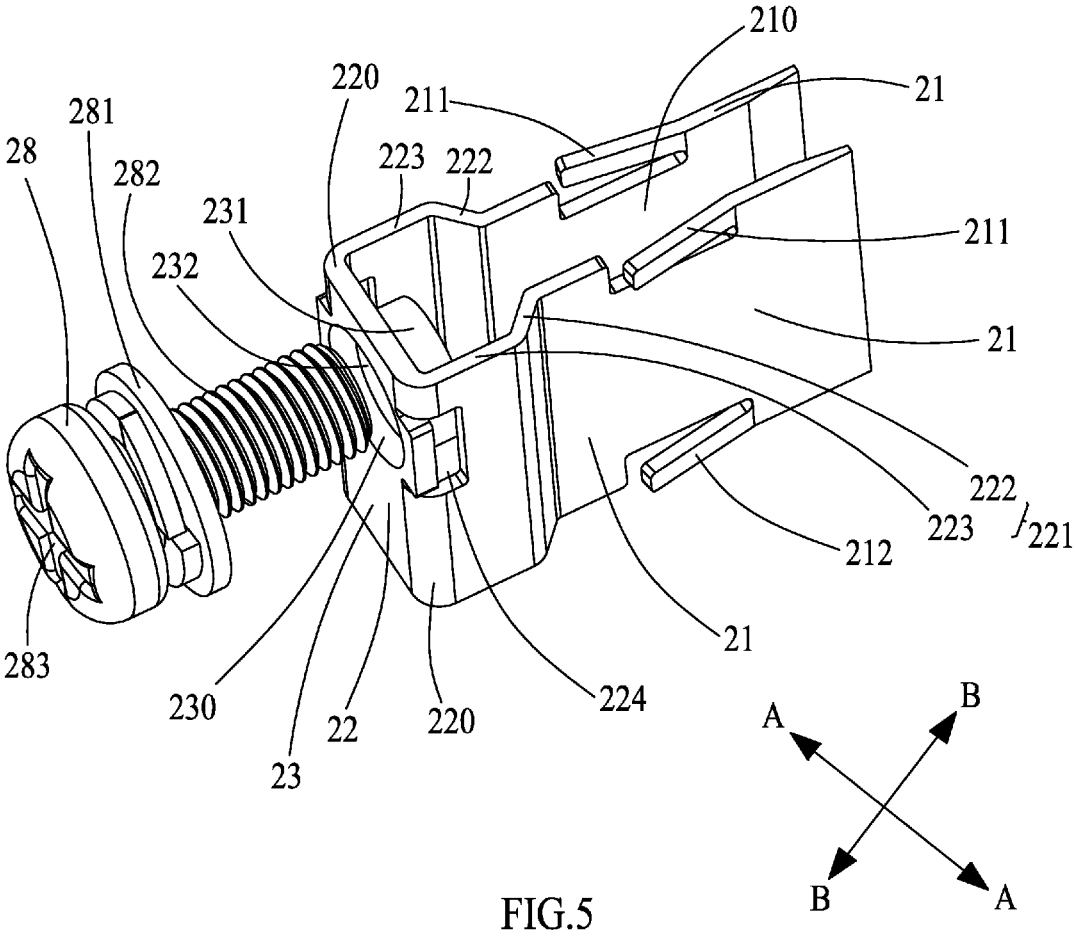
FIG. 5 is a perspective view of a power contact and a fastening member before assembling with each other.

Referring to FIG. 5, each power contact 20 is U-shaped and includes a pair of plate-like contacting portions 21 and a connecting portion 22 connecting the pair of contacting portions 21. Each contacting portion 21 is substantially located in a vertical plane. The pair of contacting portions 21 are essentially parallel to each other and defines a spacing 210 therebetween. Each contacting portion 21 is stamped to form an upper slant beam 211 and a lower slant beam 212. The upper slant beam 211 and the lower slant beam 212 are cantilevered and extend toward the connecting portion 22. The connecting portion 22 includes a pair of extending walls 221 extending outwardly from the pair of contacting portions 21 and a fastening portion 23 essentially perpendicular to the pair of contacting portions 21. Each extending wall 221 includes a first wall 222 extending inclinedly and outwardly from the contacting portion 21 and a second wall 223 connecting the first wall 222 and the connecting portion 22. The first walls 222 and the second walls 223 of the pair of extending walls 221 are symmetrical with each other along an imaginary middle plane (not shown) therebetween.

The fastening portion 23 defines a through hole 230 and an protrusion 231 inwardly extending towards the spacing 210. The protrusion 231 defines a column cavity 232 in communication with the through hole 230 to tightly fix the fastening member 28. Besides, a width of the fastening portion 23 along the longitudinal direction A-A is greater than a distance between the pair of contacting portions 21 along the longitudinal direction A-A so that the fastening portion 23 provides much reasonable space for making the through hole 230. The connecting portion 22 defines a pair of heat-dissipation holes 224 at a boundary 220 of the second wall 223 and the fastening portion 23. The heat-dissipation holes 224 are in communication with the spacing 210.

The fastening members 28 are separately made from the power contacts 20. Each fastening member 28 is a screw according to the illustrated embodiment of the present invention. The fastening member 28 includes a head 281 and a screw portion 282 extending from the head along the transverse direction B-B. The screw portion 282 is screwed into the through hole 230 and further fastened into the column cavity 232 of the fastening portion 23. The head 281 includes a cross recess 283 for being rotatably driven by a tool (not shown) so that the screw portion 282 can be ultimately fixed to the fastening portion 23. In order to jointly hold a plurality of fastening members 28, the present invention further includes a locking piece 29 as shown in FIG. 2. The locking piece 29 includes a first side 291, a second side 292 opposite to the first side 291 and a plurality of mounting holes 293 extending through the first side 291 and the second side 292.

In assembling, the plurality of power contacts 20 are inserted into corresponding passageways 11 of the insulative housing 10 along the back-to-front direction. The pair of contacting portions 21 of each power contact 20 are essentially located adjacent to the inner side walls 103. The blocks 14 on the inner side walls 103 engage against corresponding contacting portion 21 for holding the corresponding contacting portion 21. Besides, the heat-dissipation gap formed between each contacting portion 21 and the neighboring inner side wall 103 is capable of dissipating heat. Front ends of the contacting portions 21 are stopped by the guiding blocks 13 to avoid over-insertion. The upper slant beams 211 of each pair of contacting portions 21 are received and retained in the upper positioning slots 104 and are prevented from escaping the upper positioning slots 104 along the transverse direction B-B. Similarly, the lower slant beams 212 of each pair of contacting portions 21 are received and retained in the lower positioning slots 105 and are prevented from escaping the lower positioning slots 105 along the transverse direction B-B.

Then, the plurality of fastening members 28 are assembled to the locking piece 29 from the first side 291 to the second side 292 with the heads 281 resisting against the first side 291 while the screw portions 282 extending through the mounting holes 293. The screw portions 282 are then inserted into the through holes 230 of the power contacts 20. The fastening members 28 are driven by the tool so as to securely fixed to the fastening portions 23 of the power contacts 20. As a result, the locking piece 29 joints the plurality of fastening members 28 together.

Figure 6:
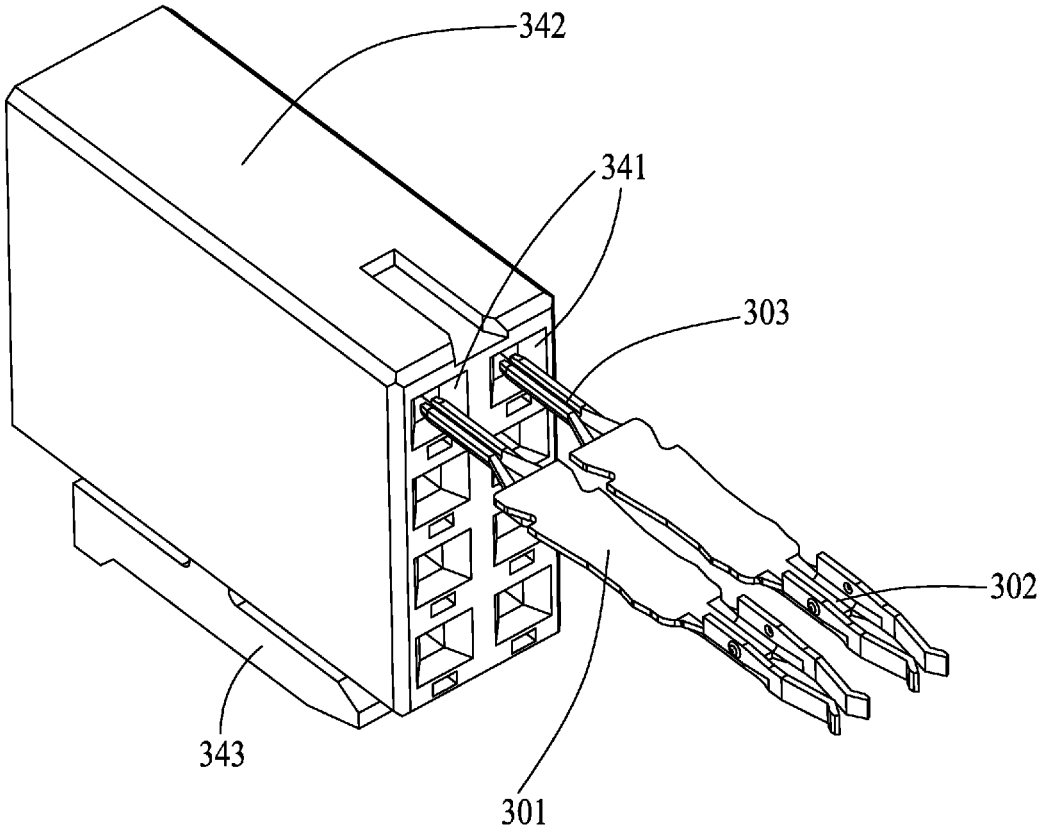
FIG. 6 is a perspective view of a terminal module showing a pair of signal contacts separated from an insulative block.

Referring to FIGS. 2 and 6, the signal contacts 30 are inserted into a plurality of contact-receiving holes 341 of an insulative block 342 to form a terminal module 34. Then, the terminal module 34 is inserted into the rear cavity 120 of the insulative housing 10. Each signal contact 30 includes a retaining portion 301 fixed in the contact-receiving hole 341, a forked contacting section 302 in alignment with corresponding mating hole 12 of the insulative housing 10, and a tail portion 303 extending from the retaining portion 301. Besides, the insulative block 342 includes a cantilevered clip 343 on a top wall thereof. The cantilevered clip 343 provides robust locking force when the terminal module 34 is combined to the insulative housing 10. Besides, from a viewpoint of manufacture, with the terminal module 34 is very effective in connector assembling.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector comprising:

an insulative housing extending along a longitudinal direction, the insulative housing has a mating surface defined thereon, a mounting surface defined opposite to the mating surface and a passageway penetrating through the mating surface, where the mounting surface and the passageway extend along a transverse direction perpendicular to the longitudinal direction;

a power contact received in the passageway of the insulative housing, the power contact comprises a pair of contacting portions and a connecting portion connecting the pair of contacting portions, the pair of contacting portions is essentially parallel to each other where a spacing is defined therebetween, the connecting portion comprises a fastening portion which is essentially perpendicular to the pair of contacting portions; and a fastening member separately made from the power contact to fasten securely to the fastening portion;

wherein the fastening portion defines a through hole thereon and the fastening member is a screw which is screwed into the through hole;

wherein the connecting portion comprises a pair of extending walls extending outwardly from the pair of contacting portions, the width of the fastening portion along the longitudinal direction is greater than the distance between the pair of contacting portions along the longitudinal direction so that the fastening portion provides a reasonable space for the forming of the through hole;

wherein each of the extending walls comprises a first wall extending outwardly from the contacting portion and a second wall connecting the first wall and the connecting portion;

wherein the connecting portion defines at least one heat-dissipation hole on the boundary between the second wall and the fastening portion, the heat-dissipation hole is in communication with the spacing.

2. The electrical connector as claimed in claim 1, wherein the fastening portion comprises an protrusion inwardly extending towards the spacing, and the protrusion defines a column cavity in communication with the through hole to fix the fastening member tightly therein.

3. The electrical connector as claimed in claim 1, wherein the first walls and the second walls of the pair of extending walls are symmetrical along an imaginary middle plane therebetween.

4. The electrical connector as claimed in claim 1, wherein the screw comprises a cross recess for being rotatably driven by a tool.

5. The electrical connector as claimed in claim 1, wherein the insulative housing comprises a pair of inner side walls with the passageway formed therebetween, at least one of the inner side walls comprises a block protruding into the passageway, the pair of contacting portions being essentially located adjacent to the inner side walls, the block engages with the corresponding contacting portion for not only holding the corresponding contacting portion but also forming a heat-dissipation gap between the corresponding contacting portion and the neighboring inner side wall.

6. The electrical connector as claimed in claim 1, wherein the insulative housing comprises a pair of inner side walls with the passageway formed therebetween and a pair of guiding blocks extending into the passageway, the guiding blocks being located adjacent to the mating surface of the insulative housing and being adapted for preventing the pair of contacting portions from being over-inserted into the passageway along a back-to-front direction.

7. The electrical connector as claimed in claim 1, wherein the insulative housing defines a pair of upper positioning slots and a pair of lower positioning slots, the upper positioning slots and the lower positioning slots being located at a top side and a bottom side of the passageway respectively, and the upper positioning slots and the lower positioning slots are in communication with the passageway; each of the pair of contacting portions comprises an upper slant beam and a lower slant beam, the upper slant beams of the pair of contacting portions are received and retained in the upper positioning slots and are prevented from escaping from the upper positioning slots along the transverse direction, similarly, the lower slant beams of the pair of contacting portions are received and retained in the lower positioning slots and are prevented from escaping the lower positioning slots along the transverse direction.

8. The electrical connector as claimed in claim 7, wherein the upper slant beam and the lower slant beam of each contacting portion are cantilevered and extend toward the connecting portion.

9. The electrical connector as claimed in claim 1, wherein the insulative housing defines a rear cavity extending through the mounting surface and a plurality of mating holes extending through the mating surface, the electrical connector further comprises a terminal module received in the rear cavity, the terminal module comprises an insulative block with a plurality of contact-receiving holes therein and a plurality of signal contacts residing in the contact-receiving holes, each signal contact comprises a forked contacting section in alignment with the corresponding mating hole.

10. A power connector comprising:

an insulative housing defining a plurality of passageways;

a plurality of U-shaped power contacts received in the passageways of the insulative housing, each power contact comprises a pair of contacting portions and a fastening portion essentially perpendicular to the contacting portions, each fastening portion has a through hole defined thereon;

a locking piece defining a first side, a second side opposite to the first side and a plurality of mounting holes penetrating through the first side and the second side; and a plurality of fastening members assembled to the locking piece from the first side to the second side, each fastening member comprising a head resisting against the first side and a screw portion inserting through the mounting hole; wherein the screw portions of the fastening members further extend through the through holes of the power contacts and ultimately fixed to the fastening portions of the power contacts.

11. The power connector as claimed in claim 10, wherein the locking piece joints the plurality of fastening members together.

12. The power connector as claimed in claim 10, wherein each fastening portion comprises an protrusion inwardly extending towards the contacting portions, and the protrusion defines a column cavity in communication with the through hole to tightly fix the screw portion.

13. The power connector as claimed in claim 10, wherein the width of each fastening portion is greater than the distance between the pair of contacting portions so that the fastening portion provides a reasonable space for the forming of the through hole.

14. The power connector as claimed in claim 10, wherein each passageway is formed by a pair of inner side walls of the insulative housing, at least one of the inner side walls comprising a block protruding into the passageway, the pair of contacting portions being essentially located adjacent to the inner side walls, the block engages against the corresponding contacting portion for not only holding the corresponding contacting portion but also forming a heat-dissipation gap between the corresponding contacting portion and the neighboring inner side wall.

15. The power connector as claimed in claim 10, wherein each contacting portion comprises an upper slant beam and a lower slant beam, the upper slant beam the lower slant beam are cantilevered and extend toward the fastening portion, the upper slant beam the lower slant beam are received and retained in the insulative housing to prevent from falling off therefrom.

16. The power connector as claimed in claim 10, wherein the insulative housing defines a rear cavity extending through a rear mounting surface and a plurality of mating holes extending through a front mating surface, the power connector further comprising a terminal module received in the rear cavity, the terminal module comprising an insulative block with a plurality of contact-receiving holes therein and a plurality of signal contacts residing in the contact-receiving holes, each signal contact comprising a forked contacting section in alignment with the corresponding mating hole.

17. An electrical connector comprising:

an insulative housing extending along a longitudinal direction, the insulative housing has a mating surface defined thereon, a mounting surface defined opposite to the mating surface and a passageway penetrating through the mating surface, where the mounting surface and the passageway extend along a transverse direction perpendicular to the longitudinal direction;

a power contact received in the passageway of the insulative housing, the power contact comprises a pair of contacting portions and a connecting portion connecting the pair of contacting portions, the pair of contacting portions is essentially parallel to each other where a spacing is defined therebetween, the connecting portion comprises a fastening portion which is essentially perpendicular to the pair of contacting portions; and a fastening member separately made from the power contact to fasten securely to the fastening portion;

wherein the insulative housing comprises a pair of inner side walls with the passageway formed therebetween, at least one of the inner side walls comprises a block protruding into the passageway, the pair of contacting portions being essentially located adjacent to the inner side walls, the block engages with the corresponding contacting portion for not only holding the corresponding contacting portion but also forming a heat-dissipation gap between the corresponding contacting portion and the neighboring inner side wall.

* * * * *